US005734102A

United States Patent [19]

Stevens

[11] Patent Number: 5,734,102

[45] Date of Patent: Mar. 31, 1998

[54] WIND DIRECTION INDICATOR AND TIME DISPLAY DEVICE FOR GOLF COURSES

[76] Inventor: Larry P. Stevens, Limestone County Rd. 358, Prairie Hill, Tex. 76678

[21] Appl. No.: 789,583

[22] Filed: Jan. 28, 1997

[51] Int. Cl.[6] ..... G01N 1/00

[52] U.S. Cl. ..... 73/170.05; 116/173; 473/173; 968/411

[58] Field of Search ..... 73/170.01, 170.05–170.08; 116/264, 273, 274, 173; 473/173, 176, 405, 167, 168, 169, 407, 150, 409; 968/398, 404, 406, 410, 411

[56] References Cited

U.S. PATENT DOCUMENTS

| | | | |
|---|---|---|---|
| 477,551 | 6/1892 | Kerr | 73/170.05 |
| 910,035 | 1/1909 | Winder | 73/170.07 |
| 1,579,034 | 3/1926 | Roberts | 116/173 X |
| 2,043,847 | 6/1936 | Wilhelm | 73/170.05 |
| 2,965,991 | 12/1960 | Simmons | 73/170.05 X |
| 3,224,268 | 12/1965 | Fenner et al. | 73/170.08 |
| 3,240,183 | 3/1966 | Walter et al. | 473/176 X |
| 4,303,243 | 12/1981 | Wolfe . | |
| 4,509,751 | 4/1985 | Tabet . | |
| 4,558,862 | 12/1985 | Kelly | 116/273 X |
| 4,719,798 | 1/1988 | Orkin | 73/170.07 |
| 4,854,579 | 8/1989 | Baxter | 73/170.07 X |
| 4,864,854 | 9/1989 | VanLeemput | 73/170.07 |
| 5,335,212 | 8/1994 | Bartos . | |
| 5,386,990 | 2/1995 | Smith . | |
| 5,451,045 | 9/1995 | Garske | 116/173 X |
| 5,523,985 | 6/1996 | Nixon . | |
| 5,540,181 | 7/1996 | Pearce . | |
| 5,615,635 | 4/1997 | Deviney | 116/173 |

*Primary Examiner*—Elizabeth L. Dougherty
*Attorney, Agent, or Firm*—Larson & Taylor

[57] ABSTRACT

A wind direction indicating and time display unit is provided for use at the tee areas of a golf course. The unit wind direction indicating device is mounted on an upper surface of a support structure and extends upwardly therefrom. The wind direction indicating device includes a support pole, a sleeve mounted for rotation on the pole at the top thereof, a wind direction indicating element, such as a flag, secured to the sleeve and movable in response to changes in wind direction, and a pole support fitting. Secured to the upper surface of the support structure. A time display device, such as a clock, is secured in a laterally facing wall surface of the support structure.

20 Claims, 2 Drawing Sheets

WIND DIRECTION INDICATOR AND TIME DISPLAY DEVICE FOR GOLF COURSES

FIELD OF THE INVENTION

The present invention relates to golf courses and, more particularly, to a wind direction indicator and time display device or unit for use on such golf courses.

BACKGROUND OF THE INVENTION

It is important for a golfer to know the wind direction. Once the wind direction is known a number of factors or measures which can compensate for the particular wind conditions can then be considered, and used, either alone or in combination. These measures include, e.g., club selection, the player's stance and the height at which the ball is teed. For example, very different measures are normally taken where the golfer is hitting into a strong head wind as opposed to hitting with a strong following wind. In this regard, the proper club selection can be radically different in the two situations, i.e., a lower numbered club than normal (i.e., whether there is substantially no wind) would generally be used when facing a head wind while a higher numbered club than normal would generally be used in the presence of a following wind.

Of course, many golfers use time honored techniques such as throwing grass into the air or testing the air with a moistened finger in an attempt to determine wind direction. However, while these techniques are commonly used, their value is limited and in some instances they can produce inaccurate results. Golfers may also rely on the wind direction of the flag at the hole being played but, of course, for many holes the flag cannot be seen and, moreover, the direction that the wind is blowing may be localized depending on the nature of the wind and the layout of the course.

There are, of course, many mechanical devices for detecting wind direction such as windsocks and the like and some devices have been developed for use on a golf course. Reference is made to, for example, U.S. Pat. Nos. 4,509,751 (Tabet), 4,864,850 (van Leemput), and 5,540,181 (Pearce). Although the devices disclosed in these patents have their merits, these devices do not provide the advantages of the present invention discussed hereinbelow. Moreover, more generally, there are restrictions in the rules of golf that prevent many kinds of wind direction indicators from being used.

A further problem commonly encountered on golf courses is slow play. A number of devices have been developed in this area, and, for example, U.S. Pat. No. 4,403,243 (Wolfe), discloses a system wherein a timer for indicating the speed of play is positioned at selected intervals, and preferably at each tee, on the golf course. Other patents of possible interest include U.S. Pat. Nos. 5,335,212 (Bartos), 5,386,990 (Smith) and 5,523,985 (Nixon).

SUMMARY OF THE INVENTION

In accordance with the invention, the problems encountered on golf courses that were discussed above are overcome in an effective, efficient manner. One important aspect of the invention involves the permanent placement of a wind direction indicator device at or closely adjacent to each tee area of a golf course as well as on the practice tee. This enables the device to be used by golfers at the tee area in determining the direction of wind, so as to aid in club selection, and to assist the golfer in determining the effect that the wind will have on the golf ball that the golfer is about to hit.

According to one important aspect of the invention, there is provided a golf course comprising a plurality of consecutive holes each having a tee area, the golf course further including a wind direction indicating device located at the tee area of each of the holes. Preferably, the golf course further comprises a practice tee, and also includes a wind direction indicating device located at that practice tee.

In accordance with a further key aspect of the invention, a time display device is supported on a common support structure with the wind direction indicating device at the tee area of each of the holes.

Preferably, each wind direction indicating device extends upwardly from the common support structure and includes a wind direction indicating element capable of assuming an orientation related to wind direction. Advantageously, each wind direction indicating element comprises a flag mounted on a pole supported by the support structure. The wind direction indicating device preferably includes a sleeve which is mounted on said pole and to which the flag is secured, the pole including axially spaced end stops between which the sleeve is captured. A pole support fitting is preferably secured to the support structure, the fitting including an opening in which the pole is received, and bolt means for retaining the pole in said fitting.

In a preferred embodiment, the time display device is recessed within the support structure. In an important implementation, the time display device comprises a clock. Advantageously, the clock is mounted in a protective, waterproof, sealed housing. The protective housing preferably includes a transparent cover face disposed flush with a portion of a side wall of the support structure. The housing advantageously comprises a cup-shaped container member having a rear wall spaced from the cover face and the clock is disposed at the rear wall in spaced relation to the cover face.

In another preferred embodiment, the time display device comprises audio means for producing an audio indication of time and a push button for activating the audio means.

Other features and advantages of the invention will be set forth in, or apparent from, the detailed description of the preferred embodiments of the invention which is found hereinbelow.

DESCRIPTION OF THE PREFERRED EMBODIMENTS

Figure 1:
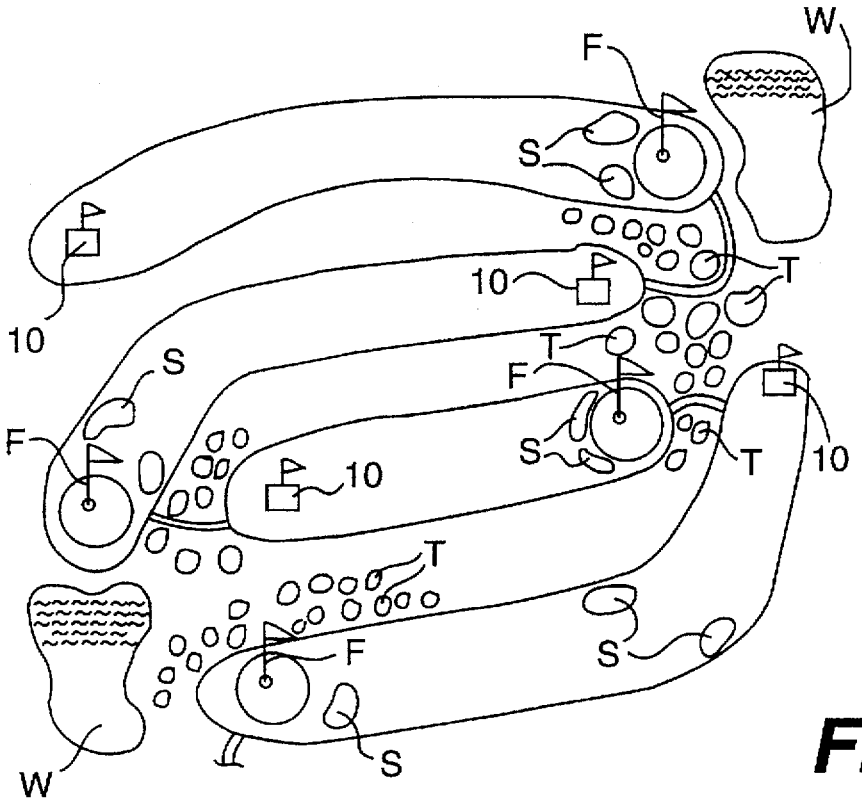
FIG. 1 is a schematic plan view of a portion of a golf course in accordance with the invention, incorporating a wind direction indicator and time display units according to the invention.

Referring to FIG. 1, a schematic plan view of a portion of a golf course is shown. While only four holes are shown in FIG. 1, it will be appreciated that the wind direction indicator and time display unit of the invention would be provided at each hole of the course and, preferably, also provided at the practice tee or tees. The wind direction indicator and time display units are denoted 10 in FIG. 1 and, as illustrated, are located at the tee areas of each of the holes. In the schematic showing in FIG. 1, the greens are indicated at G, sand traps at S, conventional flagsticks at F, water hazards at W, and trees at T. It will, of course, be understood that the layout shown is merely exemplary and that the invention is applicable to all golf courses whatever the layout or hole configuration of the course.

Figure 2:
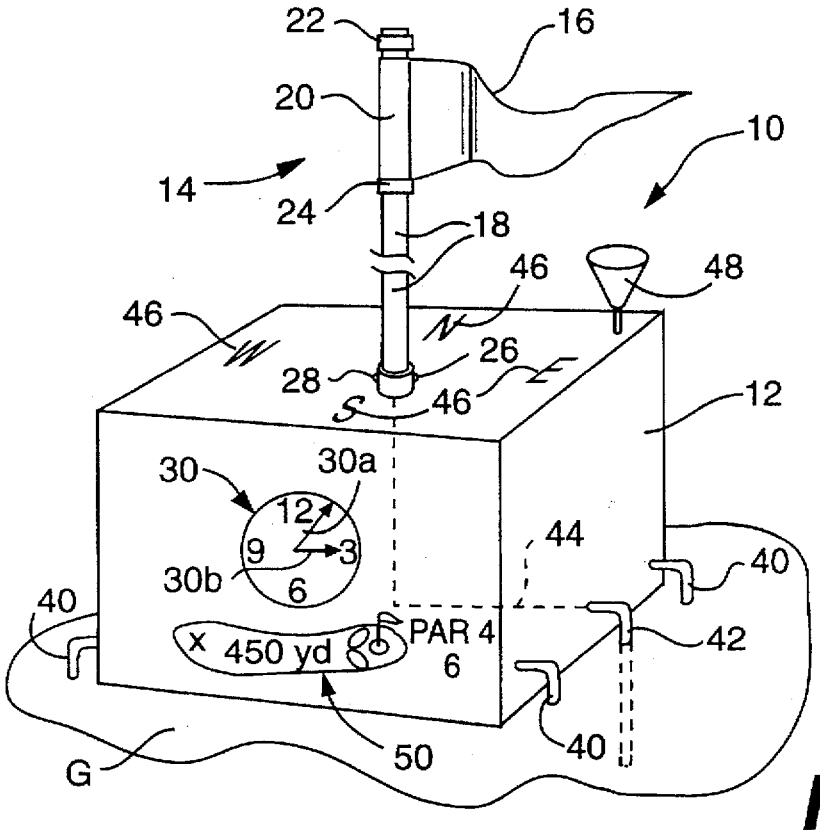
FIG. 2 is a perspective view of a wind direction indicator and time display unit constructed in accordance with a preferred embodiment of the invention.
Figure 3:
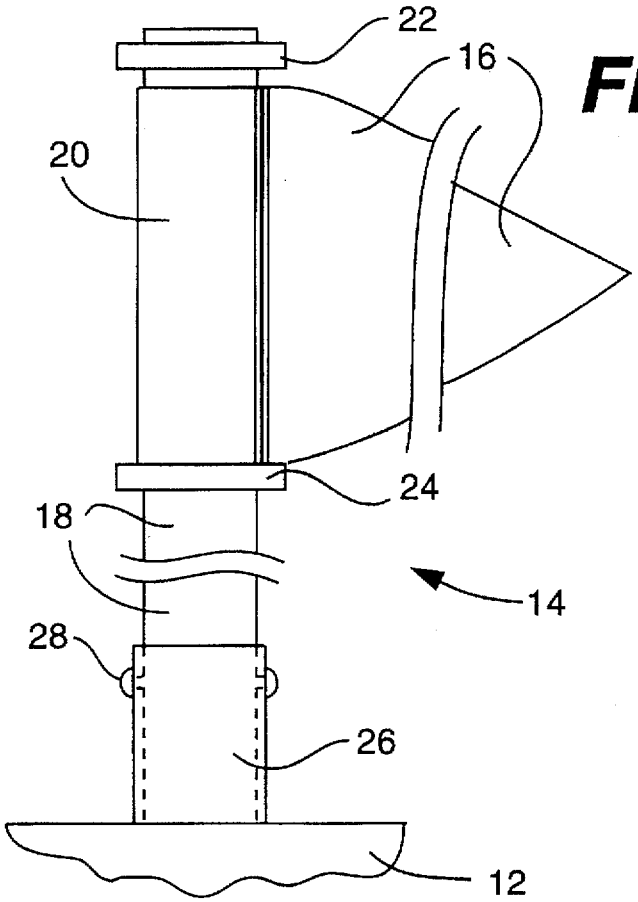
FIG. 3 is a side elevational view, drawn to an enlarged scale and partially broken away, of the wind direction indicating device of the unit of FIG. 2.

Referring to FIG. 2, there is shown a preferred embodiment of the wind direction indicator and time display unit 10. The unit 10 includes a support structure 12 which, in this embodiment, is a rectangular block. It will be understood that the support structure can vary in shape, size and material composition, depending, e.g., on the surrounding landscape of the particular golf course. Thus, the support structure 10 can be made of various materials such as rock, wood, concrete, metal and combinations of these, and, for example, rock or simulated rock could be the material of choice for a desert course. The structure can also include decorative features such as sites or locations for plantings, a water interest, such as a fountain or the like, and can generally be tailored to the desires of the course proprietor and/or owner.

A wind direction indicator 14 is mounted on the top of the support block 12 and comprises a wind indicator flag, pennant or like element 16 supported on a pole 18. As shown more clearly in FIG. 2, flag 16 includes a cylindrical sleeve 20 which fits around pole 18, and pole 18 includes upper and lower stops 22 and 24 between which sleeve 20 is captured. Pole 18 is mounted in a support fitting or base mounting sleeve 26 located on the upper surface of block 12 and preferably made of brass or other corrosion resistant material. A bolt 28 serves to removably secure pole 18 within fitting 26. The wind direction indicator flag or element 16 can be made of cloth, plastic, or the like, so as to be moved by the wind in the manner of a conventional flag, or can be constructed of other, more rigid materials such as wood and the like, so long as the wind direction indicator element 16 can be readily deflected by the wind, and through the corresponding rotation of the associated sleeve 20, can be thus positioned to indicate the wind direction. In an advantageous, exemplary embodiment, the pole 18 is approximately 12 feet tall. Multiple wind direction indicating devices may be mounted on the same structure, with the tallest preferably being no greater than 12 feet in height.

Figure 5:
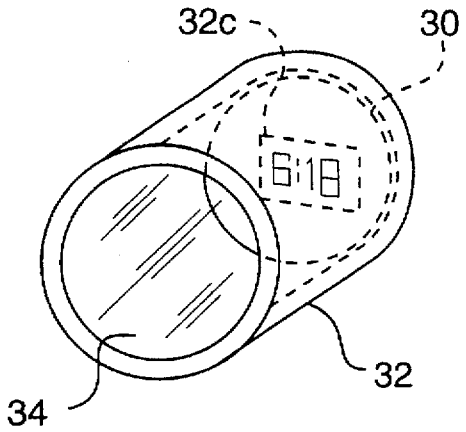
FIG. 5 is a perspective view, drawn to an enlarged scale, of the time display device of FIG. 4.
Figure 4:
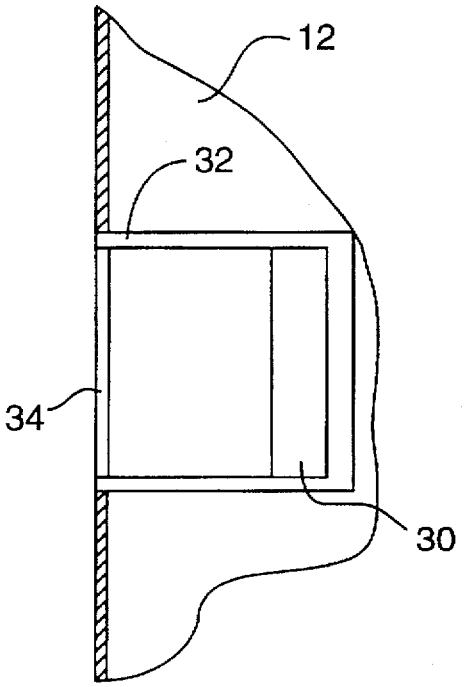
FIG. 4 is a cross sectional view, drawn to an enlarged scale, one preferred embodiment of the time display device of FIG. 2.

A time display device 30 is mounted in one laterally facing surface of support block 12. In one preferred embodiment shown in FIG. 2, the time display device comprises a clock which can provide a digital, L.E.D. (light emitting diode) display or, as illustrated in FIG. 2, can indicate time through movement of the clock hands 30*a* and 30*b*, as in other conventional clocks. In a preferred implementation of the clock embodiments illustrated in FIGS. 4 and 5, the time display device 30 is mounted in a sealed, waterproof housing or container 32 having a clear face or cover 34. The housing or container 32 is rugged in construction so as to protect the time display device 30 and may, for example, be made of a hard plastic or the like. The container 32 is also sealed against water damage, i.e., waterproof, as noted above. The cover or face 34 of container 32 is disposed flush with the surface of block 12, as shown in FIG. 4, so that the time display device 30 is recessed from this surface. A digital display 32*c* is shown in FIG. 5.

Figure 6:
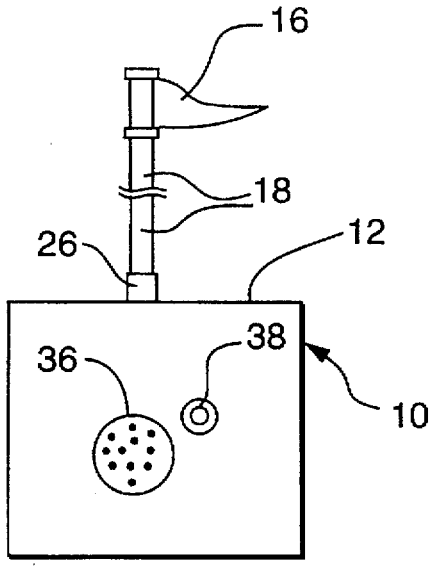
FIG. 6 is a side elevational view of another embodiment of the invention, showing a further preferred embodiment of the time display device.

In a further preferred embodiment illustrated in FIG. 6, the time display device comprises a concealed or hidden time keeping device (not shown) which [has] provides audio output through a loudspeaker 36, and which is actuated by a pushbutton 38. This enables a golfer, or the course marshall, to access the time. Such devices are, of course, conventional per se.

Referring again to FIG. 2, support block 12 is anchored to the ground G by a series of anchor members 40 which are embedded in block 12 and extend into the ground G. Other or different anchoring can also be provided. A grounding rod 42 is connected through an electrical connector 44 to the support fitting 26 for pole 18 so as to provide electrical grounding of the wind direction indicator 14.

Compass direction markings (N,E,S and W) are provided on the upper surface of support block 12. The units 10 which are located at the outer reaches of the golf course, i.e., at the points furthest north, south, east and west, preferably include a rain gauge 48. The support block will, of course, provide an excellent site for other indicators and amenities found at the tee areas of golf courses such as a hole diagram and yardage indication, indicated at 50, and a golf ball washer (not shown).

Although the present invention has been described to specific exemplary embodiments thereof, it will be understood by those skilled in the art that variations and modifications can be effected in these exemplary embodiments without departing from the scope and spirit of the invention.

What is claimed is:

1. A golf course comprising a plurality of consecutive holes each having a tee area, said golf course further including wind direction and time indicating means located at the tee area of each of said holes, each said wind direction and time indicating means comprising a permanent, fixed support structure, a time display device for displaying the current time of day supported on said fixed support structure and a wind direction indicating device supported on said fixed support structure and extending upwardly from the fixed support structure, said wind direction indicating device including a wind direction indicating element capable of assuming an orientation related to wind direction.

2. A golf course as claimed in claim 1 wherein said golf course further comprises a practice tee, and includes a wind direction indicating device located at said practice tee.

3. A golf course as claimed in claim 1 wherein each said wind direction indicating element comprises a flag mounted on a pole supported by said support structure.

4. A golf course as claimed in claim 3 wherein said time display device is recessed within said support structure.

5. A golf course as claimed in claim 4 wherein said time display device comprises a clock.

6. A golf course as claimed in claim 5 wherein said clock is mounted in a protective, waterproof, sealed housing.

7. A golf course as claimed in claim 6 wherein said protective housing includes a transparent cover face disposed flush with a portion of a side wall of said support structure.

8. A golf course as claimed in claim 7 wherein said housing comprises a cup-shaped container member having a rear wall spaced from said cover face and wherein said clock is disposed at said rear wall in spaced relation to said cover face.

9. A golf course as claimed in claim 4, wherein said time display device comprises audio means for producing an audio indication of time and a push button for activating said audio means.

10. A golf course as claimed in claim 3, wherein said wind direction indicating device includes a sleeve which is mounted on said pole and to which said flag is secured, said pole including axially spaced end stops between which said sleeve is captured.

11. A golf course as claimed in claim 10, further comprising a pole support fitting secured to said support structure and including an opening in which said pole is received, and bolt means for retaining said pole in said fitting.

12. A wind direction indicating and time display unit for permanent placement at all tee areas of a golf course, said unit comprising: a support structure permanently located at a fixed location at a tee area of the golf course; a wind direction indicating device mounted on an upper surface of said support structure and extending upwardly therefrom, said wind direction indicating device comprising a pole, a sleeve mounted for rotation on said pole at the top thereof, a wind direction indicating element secured to said sleeve and movable in response to changes in wind direction, and a pole support fitting secured to said upper surface of said support structure for supporting said pole; and a time display device mounted in a laterally facing wall surface of said support structure.

13. A device as claimed in claim 12 wherein each said wind direction indicating element comprises a flag mounted on a pole supported by said support structure.

14. A device as claimed in claim 13, wherein said wind direction indicating device includes a sleeve which is mounted on said pole and to which said flag is secured, said pole including axially spaced end stops between which said sleeve is captured.

15. A device as claimed in claim 14, further comprising a pole support fitting secured to said support structure and including an opening in which said pole is received, and bolt means for retaining said pole in said fitting.

16. A device as claimed in claim 12 wherein said time display device is recessed within said support structure.

17. A device as claimed in claim 12 wherein said time display device comprises a clock.

18. A device as claimed in claim 12, wherein said time display device comprises audio means for producing an audio indication of time and a push button for activating said audio means.

19. A golf course as claimed in claim 1 wherein said support structure comprises a support block and securing means for securing said support block in place on a ground surface of the corresponding tee area.

20. A golf course as claimed in claim 19 wherein said securing means comprises a plurality of anchor members.

* * * * *